US006240605B1

(12) United States Patent
Stevens et al.

(10) Patent No.: US 6,240,605 B1
(45) Date of Patent: Jun. 5, 2001

(54) REINFORCING CLIP FOR LASER TONER CARTRIDGES

(75) Inventors: Jerry Stevens, Cameron; William L. London, Sanford, both of NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 09/389,792

(22) Filed: Sep. 3, 1999

(51) Int. Cl.[7] ..... A44B 17/00; A44B 21/00; G03G 15/08

(52) U.S. Cl. ..... 24/546; 24/459; 24/547; 24/545; 399/106

(58) Field of Search ..... 24/546, 545, 547, 24/459

(56) References Cited

U.S. PATENT DOCUMENTS 809,049 * 1/1906 Gillett ..... 24/547
1,681,925 * 8/1928 Anderson ..... 24/24
4,605,978 * 8/1986 Zeavin ..... 360/104
5,799,712 * 9/1998 Kelly et al. ..... 141/287
5,937,238 * 8/1999 Tremblay et al. ..... 399/109
5,941,434 * 8/1999 Green ..... 224/250
5,979,025 * 11/1999 Horng ..... 24/459
6,014,534 * 1/2000 Goebel et al. ..... 399/106
6,079,084 * 6/2000 Gwynn ..... 24/350

FOREIGN PATENT DOCUMENTS

0655633 * 4/1929 (FR) ..... 24/545

* cited by examiner

*Primary Examiner*—Victor N. Sakran
(74) *Attorney, Agent, or Firm*—William London

(57) ABSTRACT

The present invention relates to a device for use in remanufactured toner cartridges in which the toner hopper has been physically separated from the developer roller housing. The device holds the toner hopper and developer roller housing in proper alignment to one another and the component parts within. The nature of this device is disclosed and described herein.

17 Claims, 6 Drawing Sheets

REINFORCING CLIP FOR LASER TONER CARTRIDGES

FIELD OF INVENTION

Many imaging devices such as copiers, laser printers, facsimile machines use toner cartridges. The toner cartridge contains many of the moving parts of the machine and contains a finite supply of toner. The original equipment manufacturers intended for the consumer to use the toner cartridge until the initial toner supply is exhausted, and then replace it with a new laser toner cartridge. By placing many of the moving parts in the toner cartridge and making the toner cartridge disposable, the OEM reduced the amount of repair work required on the printers, copiers, or facsimile machines.

The used toner cartridge has many components that may be reused. An industry known as the remanufacturing industry has arisen to take advantage of this fact. Remanufacturers take used toner cartridges, clean them, repair damaged components, replace worn out components, and add new toner. Remanufacturers frequently saw apart a portion of the toner cartridge, called the toner hopper subassembly. The toner hopper subassembly is separated into the developer roller housing, and the toner hopper. As explained in U.S. Pat. No. 5,223,068 to Raymond Baley, the separation is done in order to achieve a surface on which a seal may be placed over the toner hopper. By separating the toner hopper from the developer roller housing, remanufacturers duplicate the condition the cartridge was in when it was new. The original equipment manufacturer takes a toner hopper, section seals it, and the ultrasonically welds it to a developer roller housing. After remanufacturers place a seal over the toner hopper discharge opening they then reattach the toner hopper to the developer roller housing. This reattachment may be done by gluing the two sections together as disclosed in Baley. More often, remanufacturers use a rail system to mechanically compress the developer roller housing against the toner hopper. By using a clamping rail, instead of a glue, a remanufacturer may simply and easily separate the cartridge on its next remanufacturing cycle by simply removing the rails and separating the developer roller housing from the toner hopper. No sawing is required on the second cycle if a reusable rail system is used.

Original equipment manufacturers are using thinner and thinner plastic for the toner hopper and developer roller housing. The tier plastic used means that the plastic bends and flexes more easily. The original equipment manufacturer relies on the ultrasonic welding process to impart rigidity to the developer roller housing and to the toner hopper.

In the clip and rail system used by remanufacturers, this extra reinforcing is not available. As a result, the magnetic developer roller housing will bow sometimes inward and sometimes outward relative to its position when new. Either position may lead to print defects when the cartridge is installed. This invention is designed to work with the clip and rails systems to prevent these problems by holding the clamped toner hopper aligned with the developer roller housing.

SUMMARY OF INVENTION

A reinforcing clip for toner cartridges of this invention has a first engaging end that engages the developer roller housing and a second engaging end that engages the toner hopper, and a connector connecting the first engaging end to the second engaging end. The connector has a reference surface. When the reinforcing clip is installed, the first end is in contact with the toner hopper, the second end is in contact with the developer roller housing and the reference surface is in contact with the seam between the toner hopper and developer roller housing. The reinforcing clip is of a sufficiently stiff material to hold the developer roller housing in proper alignment with the toner hopper. The reinforcing clip may take a variety of shapes to engage the developer roller housing and toner hopper. A developer roller link may be attached to the developer roller housing or a toner hopper link may be added to the toner hopper to facilitate attachment of the reinforcing clip.

BRIEF DESCRIPTION OF DRAWING

This invention is explained below in detail referring to accompanying drawing.

DETAILED DESCRIPTION

The reinforcing clip of this invention serves two functions. It provides added rigidity to the toner hopper and developer roller housing, and it maintains the developer roller housing and toner hopper in proper alignment. The reinforcing clip of this invention does so by attaching to the developer roller housing, the toner hopper, and the seam in such a way as to hold the toner hopper in the proper orientation to one another, and by adding a stiffening element perpendicular to the length of the toner hopper and developer roller housing. The invention may be used by remanufacturers who separate toner hoppers from developer roller housings and then reattach the same. The invention may be used in conjunction with a gluing system, but will be of particular use to remanufacturers using rail systems or clip systems to clamp the toner hopper to the developer roller housing. The reinforcing clip is substantially rigid insuring that the developer roller housing and toner hopper will maintain proper alignment and stiffness.

Figure 7:
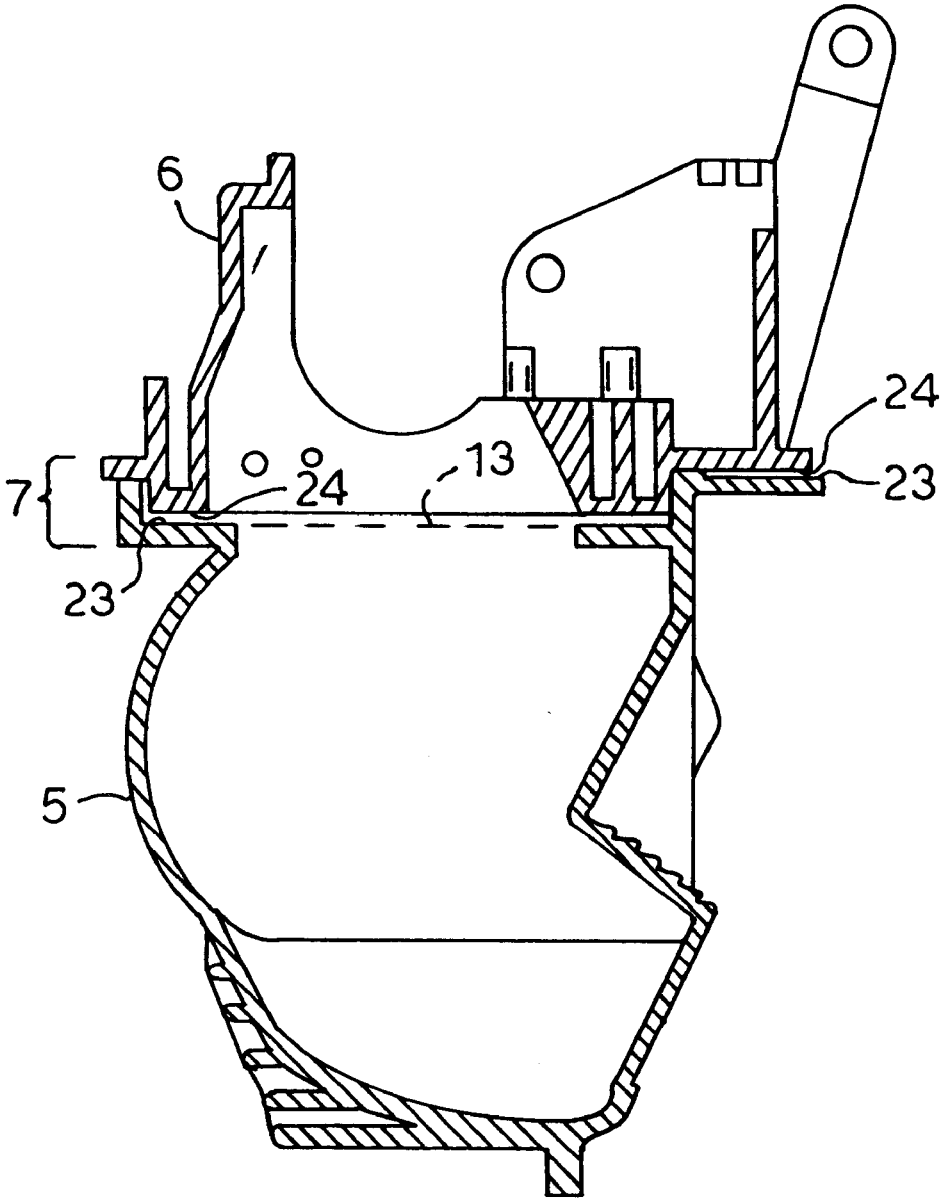
FIG. 7 illustrates a toner cartridge subassembly with toner hopper and developer roller housing.

This invention can best be understood by reference to the different drawings. As shown in FIG. 7, the toner hopper subassembly 22 has a toner hopper section 5 and a developer roller housing section 6. Toner hopper 5 has a flange 23 around the perimeter of the toner hopper 5. Similarly, the developer roller housing 6 has a flange 24 around the perimeter of the developer roller housing. When the toner hopper 5 is placed against the developer roller 6 these flanges meet and form the seam 7. In a new toner cartridge the OEM ultrasonically welds the flange of 24 of the developer roller housing 6 to the flange 23 of the toner hopper 5.

Remanufacturers frequently separate the developer roller housing 6 from the toner hopper 5 by cutting the flanges at the seam 7. The remanufacturers separate the toner hopper 5 from the developer roller housing 6 in order to expose the flange 23 of the toner hopper on which a new seal can be placed. The new seal (not shown) closes the toner hopper discharge opening 13 and allows toner to be placed in the toner hopper 5 without spilling during transportation. The seal is removed by the end user shortly before placing the toner cartridge in the printer. Removal of the seal allows toner to flow from the toner hopper 5 through the toner hopper discharge opening 15 to the developer roller (not shown) which sits in the developer roller housing 6.

Figure 1:
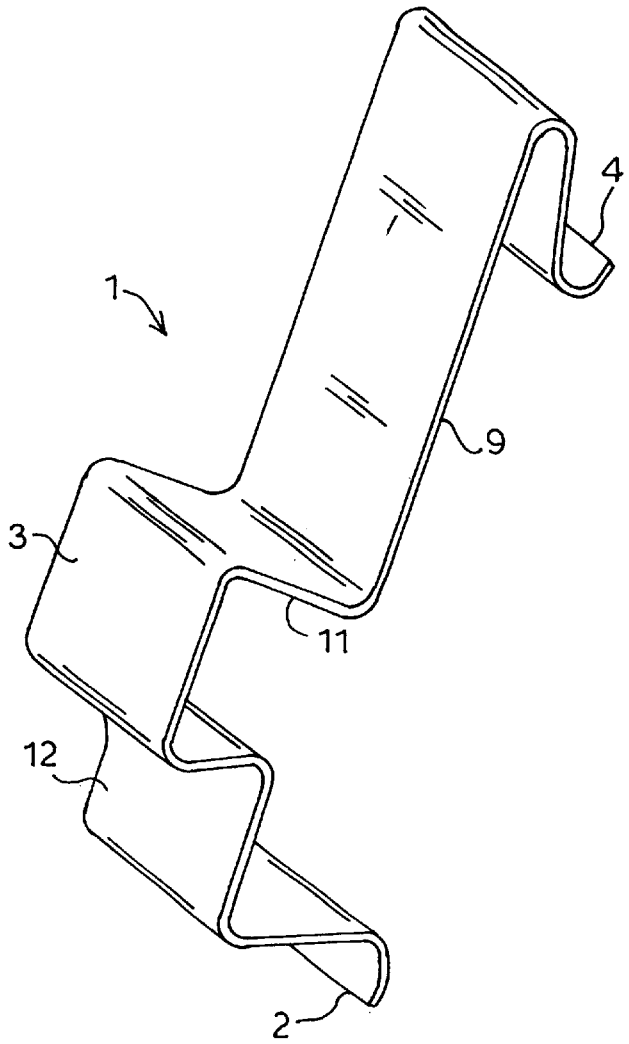
FIG. 1 is a three-quarter's view of one example of the reinforcing clip of this invention.
Figure 2:
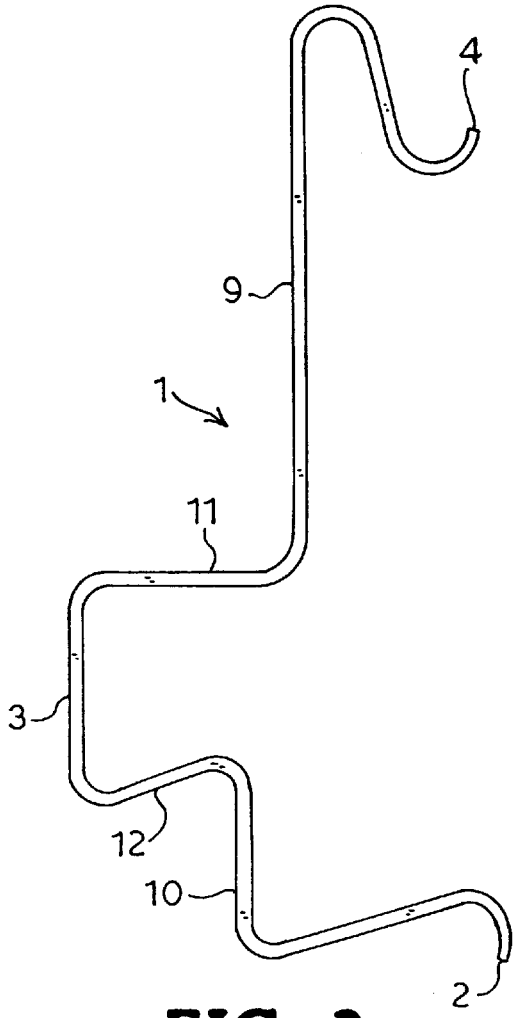
FIG. 2 is a cross sectional view of one example of one embodiment of the reinforcing clip of this invention.
Figure 3:
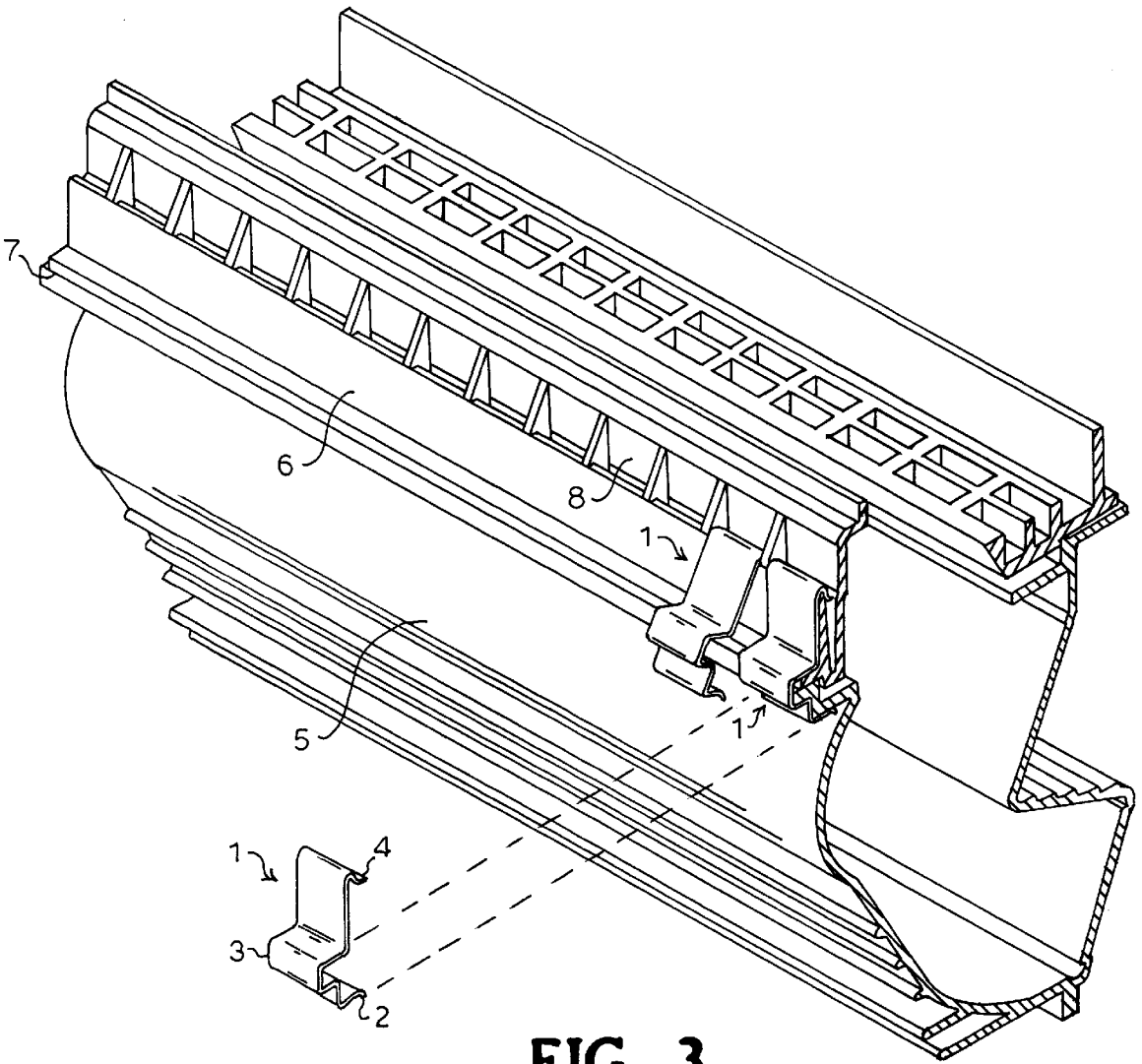
FIG. 3 is a view of a toner cartridge with one embodiment of reinforcing clip of this invention.

As depicted in FIG. 3, the reinforcing clip 1 is a single piece of relatively stiff material. In the preferred embodiment the material is a steel although other metals, and stiff plastics may be used. The reinforcing clip has a first end 2 with a planer-connecting surface shaped to engage the toner hopper. It has a second end 4 with a connecting surface shaped to engage the developer roller housing 6. The developer roller housing 6 on some cartridges such as the Hewlett Packard 5000 have pockets 8 molded into the developer roller housing 6. These pockets 8 were designed by the OEMs as reinforcing members for the thinner plastics of the newer cartridges. The connecting surface of the second end 4 is shaped to engage the developer roller housing 6 by fitting into the pockets 8 on the developer roller housing 6. As illustrated in FIG. 2, the connecting surface 10 first end 2 conforms to the external shape of the toner hopper 5. The first and second end are connected by a connector which has a reference surface 3 shaped to rest against the seam 7 formed at the place where the developer roller housing and the toner hopper connect. The stiffness of the reinforcing clip 1 serves two functions. First, if the developer roller housing 6 is inclined to bow in toward the toner hopper discharge opening, or outward, away from the toner discharge opening 13 the stiff spring like material will create a force to pull or push the developer roller housing into proper alignment. Furthermore, once in position the reinforcing clip of this invention will continue to exert a force inward or outward against the developer roller housing so that the first end 2 and the second end 4 will remain in a set position relative to the reference surface 3. As illustrated in FIG. 2, the distance between the surface 9 of the reinforcing clip 1 which engages the magnetic developer roller housing 6 will remain a set distance 11 from the reference surface 3. Similarly, the first end 2 has a connecting surface 10 in contact with relatively flat planer area of the toner hopper 5. This surface 10, remains a set distance 12 from the reference surface 3. The reinforcing clip of this invention will cause the toner hopper and magnetic developer roller housing to remain in a relatively fixed alignment, and will act as a spring moving the developer roller housing 6 inward or outward to maintain the proper alignment.

Figure 4:
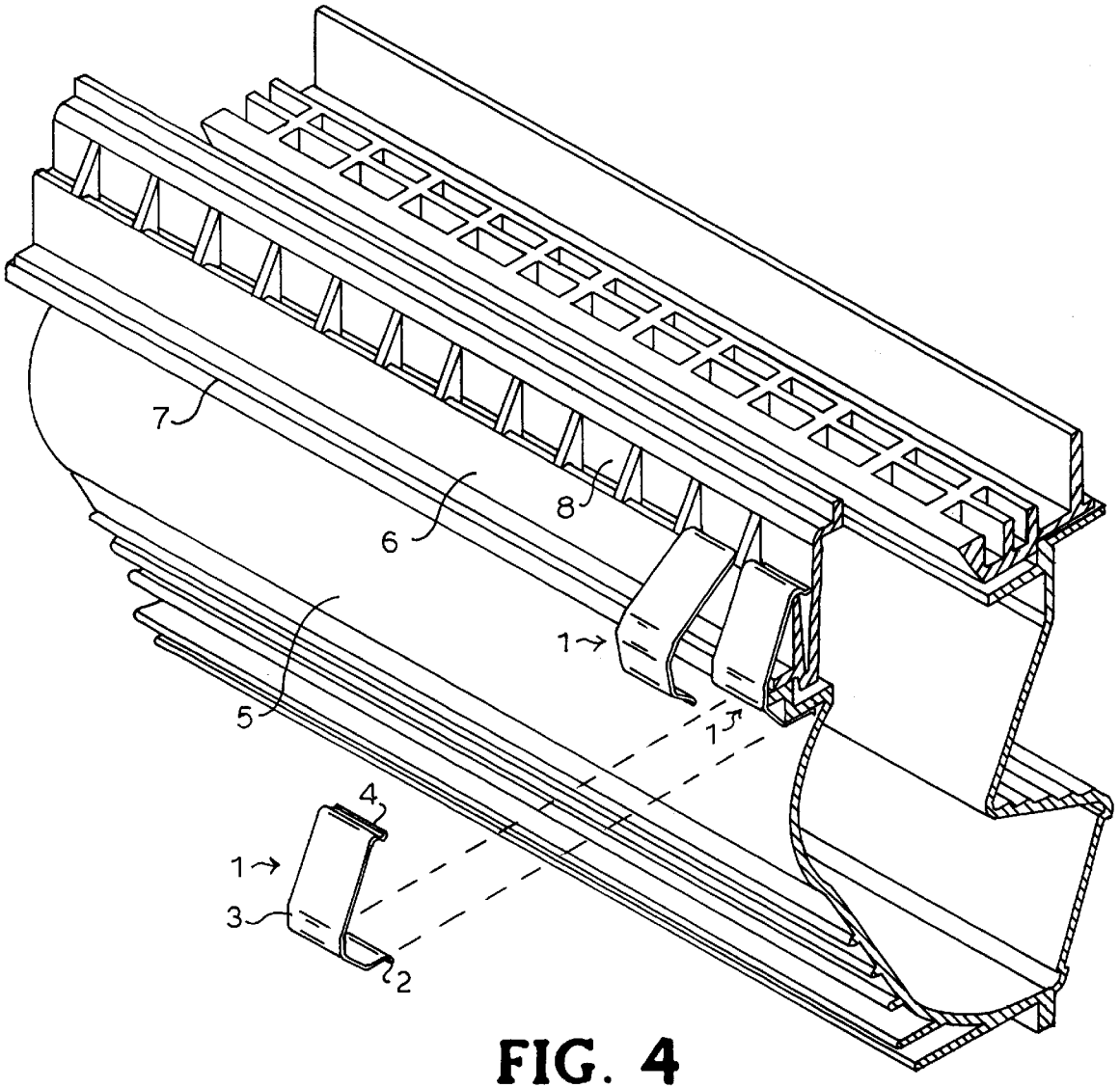
FIG. 4 is a depiction of a toner cartridge with another example of the reinforcing clip of this invention.
Figure 5:
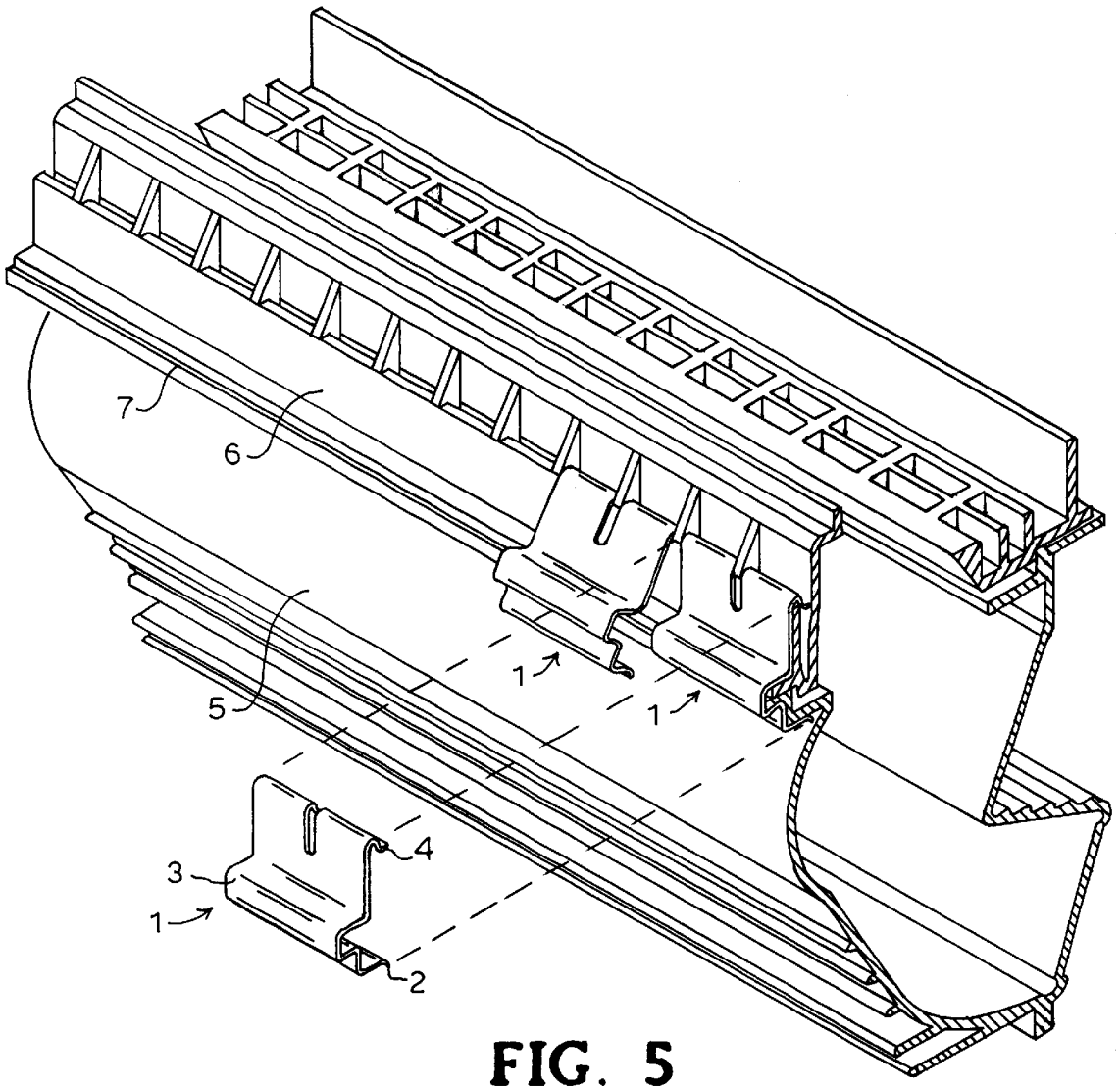
FIG. 5 is a view of a toner cartridge with another embodiment of the reinforcing clip of this invention.

Other configurations of a reinforcing clip may be used without varying from the concept of this invention. One such embodiment is shown in FIG. 4. Yet another is shown in FIG. 5. All of these embodiments are shown with reference to the same type toner cartridge. Other obvious modifications to the first end 2, the second end 4 and the reference 3 may be made to match the configuration of a particular toner cartridge for which the clip is intended.

Figure 6:
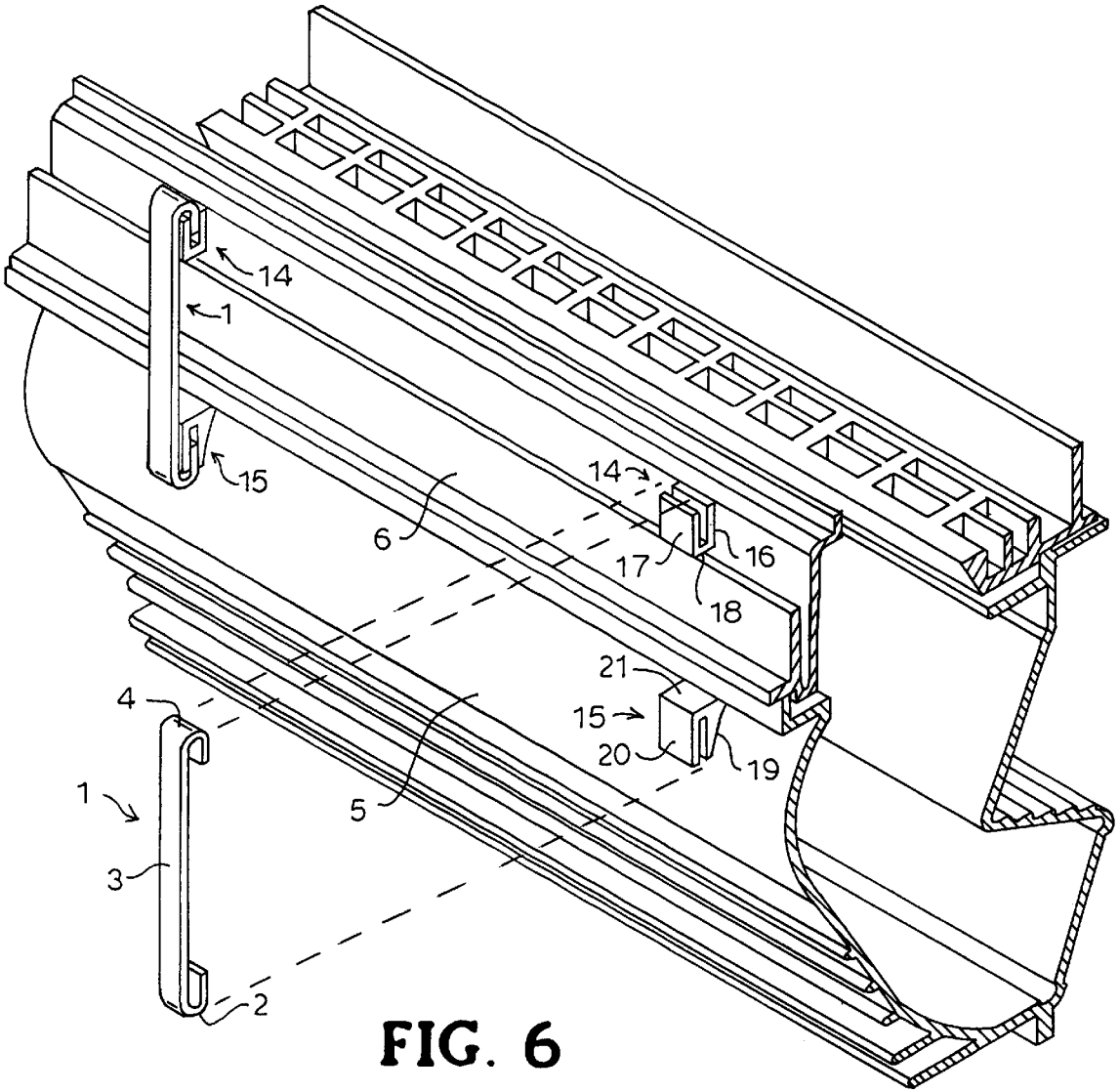
FIG. 6 is another view of the toner cartridge with another embodiment of the reinforcing clip of this invention.

One of the keys to moving the developer roller housing in or out is the fact that the connecting surface 9 of the second end 4 hooks over the edge of the pockets 8 on the developer roller housing 6 allowing the second end to pull the developer roller housing out, away from the toner hopper discharge opening 13. Some toner cartridge designs may not have pockets 8 (FIG. 3), or may have pockets that are inadequate for the purpose of this invention. For such laser toner cartridges substitute pockets may be placed on either the toner hopper or developer roller housing. These substitute pockets are the developer roller link 14, and the toner hopper link 15. As depicted in FIG. 6, the development roller link 14 is attached to the developer roller housing 6. The attachment may be permanently, as by glue, or by some mechanical fastener. The development roller link 14 has an attachment surface 16 separated by a gap from a connecting surface 17. The second end 4 of the reinforcing clip 1 fits into the pocket formed by the surfaces 16 and 17, and the connector 18 between them.

The toner hopper link 15 is similarly constructed. It has an attachment surface 19, a connecting surface 20, and a connector 21 between them forming a pocket into which the first end 2 of the reinforcing clip 1 can be inserted.

Besides using a development roller link 14 and a toner hopper link 15 the means of attaching the toner hopper and developer roller housing a reinforcing clip 1 is used. The reinforcing clip may be attached by use of a screw directly to the surface of the developer roller housing and to the surface of the toner hopper. It may attached using glue, or pieces of hook and loop reusable closures may be added to the reinforcing clips first end 2 and second end 4 to attach to hook and loop reusable closures glued on to the developer roller housing 6 or the toner hopper 5. Other variations and departures from the specific embodiment disclosed herein may also be used without departing from the spirit of this invention.

The advantage of this invention is that the reinforcing clip will bring the toner hopper and magnetic developer roller housing into proper alignment with one another without the need to permanently attach the two. The convenience of clamping systems is retained along with the reinforcing characters to set more permanent attachment means. Although this invention has been described with respect to the specific embodiments herein, it should be understood that the invention is not limited to these embodiments, they make take other shapes and forms to accommodate the particular toner cartridges at issue.

We claim:

1. A reinforcing clip in combination with a laser toner cartridges that have a toner hopper subassembly with a toner hopper and a developer roller housing the toner hopper and developer roller housing having a seam when placed together, said reinforcing clip comprising:

a first end with a connecting surface shaped to engage the toner hopper;

a second end with a connecting surface shaped to securely engage the developer roller housing in at least two orthogonal directions;

a connector connecting the first and second ends, said connector having a reference surface shaped to rest securely against the seam pulling the first end and the second end toward the reference surface when the connecting surface of the first end is engaged with the toner hopper and the connecting surface of the second end is engaged with the developer roller housing.

2. A reinforcing clip as in claim 1, further comprising a toner hopper link with a first surface shaped to mate with the toner hopper, and a second surface shaped to engage the planer connecting surface of the first end, and means for attaching the toner hopper link to the toner hopper.

3. A reinforcing clip as in claim 2, wherein the means for attaching the toner hopper link to the toner hopper is an adhesive.

4. A reinforcing clip as in claim 2, wherein the means for attaching the toner hopper link to the toner hopper is a screw.

5. A reinforcing clip as in claim 1, wherein the connecting surface of the second end is shaped to conform to the hood of the developer roller housing.

6. A reinforcing clip as in claim 1, wherein the connecting surface of the second end is shaped to removably engage a pocket on the developer roller housing.

7. A reinforcing clip as in claim 1, wherein the connecting surface of the second end is shaped to engage more than one pocket on the developer roller housing.

8. A reinforcing clip as in claim 1, wherein the connector is made from a stiff spring steel.

9. A reinforcing clip as in claim 1, wherein the connector is made of a stiff resilient plastic.

10. A reinforcing clip as in claim 2, wherein the first engaging means to engage the toner hopper is a hook and loop connector attached to the toner hopper, and to the connecting surface of the first end.

11. A reinforcing clip is in claim 2, wherein the second engaging means to engage the developer roller housing is a hook and loop connector attached to the connecting surface of the second end of the developer clip and a corresponding piece of hook and loop connector attached to the developer roller housing.

12. The reinforcing clip as in claim 1 in which the first engaging means and the second engaging means are glue.

13. A reinforcing clip as claim 1 wherein the first engaging means and the second engaging means is a screw.

14. A reinforcing clip as in claim 1 wherein the first engaging means is a first end with a connecting surface shaped to engage the toner hopper, and the second engaging means is a second end with a second surface shaped to engage a pocket formed in the developer roller housing.

15. A reinforcing clip in combination with a laser toner cartridges that have a toner hopper subassembly with a toner hopper and a developer roller housing the toner hopper and developer roller housing having a seam when placed together, said reinforcing clip comprising:

a first end with a connecting surface shaped to engage the toner hopper;

a second end with a connecting surface shaped to securely engage the developer roller housing in at least two orthogonal directions;

a connector connecting the first and second ends, said connector having a reference surface shaped to rest securely against the seam pulling the first end and the second end toward the reference surface when the connecting surface of the first end is engaged with the toner hopper and the connecting surface of the second end is engaged with the developer roller housing;

a developer roller housing link said developer roller housing link having a first surface shaped to mate with the developer roller housing and a second surface shaped to engage the planer connecting surface of the second end; and means for attaching the first surface of the development roller-housing link to the developer roller housing.

16. A reinforcing clip as in claim 15, wherein the means for attaching the development roller-housing link to the developer roller housing is an adhesive.

17. A reinforcing clip as in claim 15, wherein the means for attaching the development roller-housing link to the developer roller housing is a screw.

* * * * *